United States Patent [19]

Yang

[11] Patent Number: 4,902,932

[45] Date of Patent: Feb. 20, 1990

[54] SOCKET-ADAPTER STABILIZING DEVICE FOR MINIATURE FLUORESCENT LAMPS

[76] Inventor: Jiun-Fu Yang, 2nd Fl., No. 149, Ching Hsing Rd., Taipei, Taiwan

[21] Appl. No.: 317,087

[22] Filed: Feb. 27, 1989

Related U.S. Application Data

[63] Continuation of Ser. No. 922,453, Oct. 23, 1986, abandoned.

[51] Int. Cl.[4] ..... H01J 17/34

[52] U.S. Cl. ..... 315/71; 315/58; 29/606; 336/216; 336/221

[58] Field of Search ..... 315/58, 70, 71; 29/605, 29/606; 336/216, 221, 226

[56] References Cited

U.S. PATENT DOCUMENTS

| | | | |
|---|---|---|---|
| 1,690,154 | 11/1928 | Alden | 29/606 |
| 4,570,105 | 2/1986 | Engel | 315/71 |
| 4,683,402 | 7/1987 | Aubrey | 315/58 |

*Primary Examiner*—Robert L. Griffin

*Assistant Examiner*—T. Salindong

*Attorney, Agent, or Firm*—Saidman, Sterne, Kessler & Goldstein

[57] ABSTRACT

An improved stabilizing device incorporated into a socket-adapter for miniature fluorescent lamps includes a square-shaped iron core member with a coil arrangement provided therearound so as to form a required stabilizing device with a square open section defined in a middle portion for accommodating a socket seat of the socket-adapter for known miniature fluorescent lamps. The iron core member is composed of a plurality of L-shaped silicon steel laminated cores, and the coil arrangement includes a plurality of coils wound around a plurality of I-shaped coil frames, each of which has a through opening in a middle portion for being sleevingly installed around both arms of the L-shaped laminated cores so as to form a square open section in the middle of the iron core for accommodating the socket seat of the socket-adapter. Thereby, the total volume of the socket-adapter stabilizing device is substantially decreased.

1 Claim, 2 Drawing Sheets

SOCKET-ADAPTER STABILIZING DEVICE FOR MINIATURE FLUORESCENT LAMPS

This application is a continuation of application Ser. No. 922,453 filed Oct. 23, 1986, now abandoned.

BACKGROUND OF THE INVENTION

This invention relates to a stabilizing device, and more particularly to an improved small-size stabilizing device adapted to a socket-adapter for miniature fluorescent lamps.

As shown in FIG. 1, a miniature fluorescent lamp developed by the Philips Co. of the Netherland is increasingly demanded on the market because of its small size, energy efficiency, brightness and long life expectancy. This kind of fluorescent lamp includes an elongated U-shaped lamp tube 1 and a plugging head 2, which, in addition to a pair of metal prongs 21 and a protrusion catch 22 provided for being detachably connected to a socket-adapter (as shown in FIG. 2), has an actuator (not shown) electrically installed therein in conjunction with the lamp tube 1.

Shown in FIG. 2 is a known socket-adapter designed for the miniature fluorescent lamp. This kind of socket-adapter is simply a modification of the plugging head 2 of the fluorescent lamp shown in FIG. 1. To use the lamp, the required stabilizer has to be disposed separately in the power source, causing considerable inconvenience. The reasons for separating the stabilizer from the socket-adapter are: (1) the volume of the socket-adapter has to be limited to about 5 cm in diameter and 5 cm in height, and no stabilizer can be incorporated into it simply because the size of the stabilizer is larger than the volume of the socket-adapter; (2) as the known stablizer is usually formed with E-shaped iron core made of silicon steel laminates, around which are wound wires, and which are held in position within a frame, the slits formed between the silicon steel laminates of the iron core can easily cause magnetic loss and increase heat in the iron core of the stabilizer. In order to solve the problem above, the size of the iron core is enlarged and the insulation of the used material is reinforced. As a result, not only is the volume of the stabilizer augmented but the manufacturing cost is also increased. For the above reasons, no stabilizer is built in the known socket-adapter for miniature fluorescent lamps.

Shown in FIG. 3 is a socket-adapter designed by this inventor for miniature fluorescent lamps. As can be seen in the drawing, the socket-adapter includes a stabilizer disposed on top of the socket-adapter with the plugging head 2 of the miniature fluorescent lamp 1 being connected at a lower end of the socket-adapter. Although the structure of this socket-adapter is an improvement over the traditional socket-adapter with its problems as mentioned in (1) and (2) above, the total size is still too great because the iron core of the stabilizer has windings provided in the center, and the plugging head 2 of the fluorescent lamp 1 can be connected only to the lower end of the socket-adapter.

SUMMARY OF THE INVENTION

It is a primary object of this invention to provide an improved stabilizing device incorporated into a socket-adapter for miniature fluorescent lamps so as to decrease the volume of the socket-adapter as well as meet production requirements of the miniature fluorescent lamps.

This and other objects are obtained by the improved stabilizing device provided according to this invention. The stabilizing device comprises a square-shaped iron core means with a coil arrangement electrically wound therearound so as to provide a stablizing device with a square open section defined in a middle portion thereof for accommodating a socket seat of the socket-adapter for the known miniature fluorescent lamp. The square-shaped iron core means is combined of a plurality of L-shaped silicon steel laminated cores which are respectively disposed in a through opening of a plurality of I-shaped coil frames upon which coils are respectively wound. The assembled stabilizing device according to this invention is electrically installed and properly secured in a plastic housing unit of a known socket-adapter. Therefore, the entire unit of the stabilizing device incorporated with the socket-adapter, together with the miniature fluorescent lamp plugged into the socket-adapter, is formed in a compact volume. Thus not only is the whole length of the socket-adapter greatly shortened, but the manufacturing cost is also decreased accordingly.

Other advantages and characteristics of this invention will become apparent from the following detailed description of a preferred embodiment when read in conjunction with the accompanying drawings.

DETAILED DESCRIPTION OF THE PREFERRED EMBODIMENT

Figure 1:
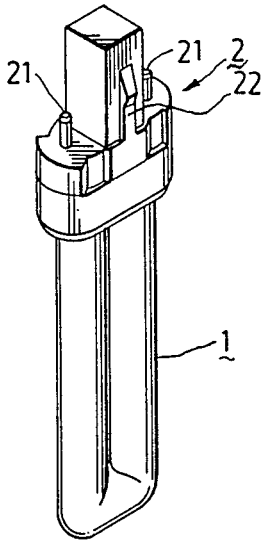
FIG. 1 PRIOR ART
FIG. 1 is a structural illustration of a known miniature fluorescent lamp.
Figure 2:
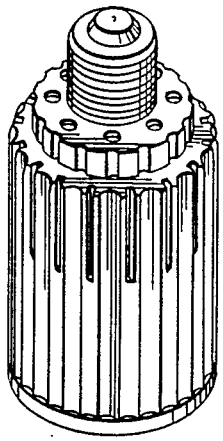
FIG. 2 (PRIOR ART)
FIG. 2 is an illustration of a known socket-adapter without a stabilizer disposed therein for the fluorescent lamp shown in FIG. 1.
Figure 3:
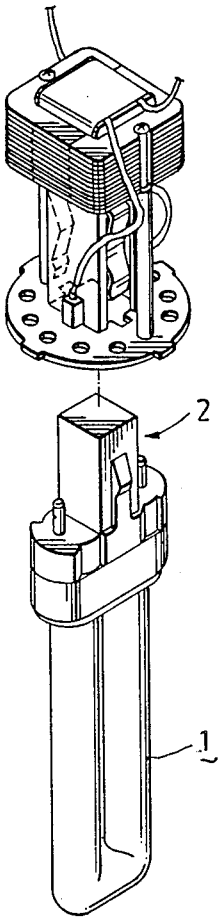
FIG. 3 (PRIOR ART)
FIG. 3 is an illustration of a known socket-adapter with a known stabilizer provided on top of the socket-adapter for the fluorescent lamp shown in FIG. 1.
Figure 4:
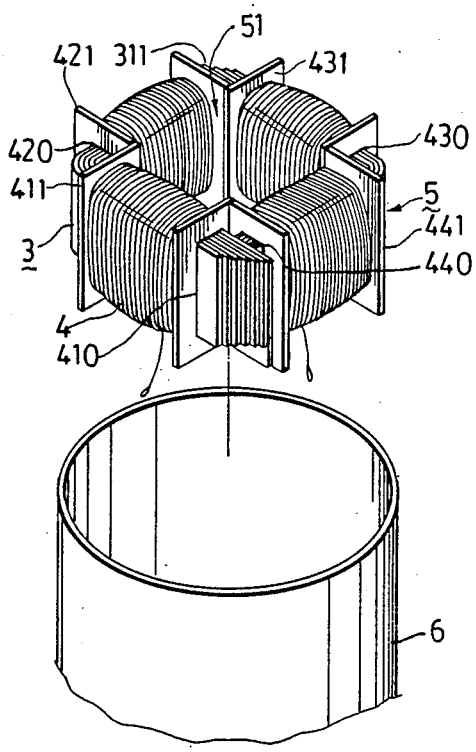
FIG. 4 is an isomatic and perspective view of a preferred embodiment of an assembled stablizing device to be incorporated into a socket-adapter for fluorescent lamp, according to this invention.

Referring to FIG. 4, the preferred embodiment of a stabilizing device incorporated into a socket-adapter for miniature fluorescent lamp according to this invention comprises a square-shaped iron core 3, having a coil arrangement 4 electrically wound therearound, and thus a stabilizing device 5 is formed with an open section 51 defined in a middle portion thereof. The assembled stabilizing device 5 is then electrically installed and secured in a housing unit 6 of a socket-adapter (no structure of the socket-adapter is shown since it is a prior art known to those skilled in this field) with the open section 51 suitable for accommodating the plugging head of the known miniature fluorescent lamp (as shown in FIG. 1). Therefore, the entire size of the socket-adapter incorporating the stabilizing device.5 of this invention, together with the miniature fluorescent lamp plugged in the socket-adapter, is greatly minimized.

Figure 5:
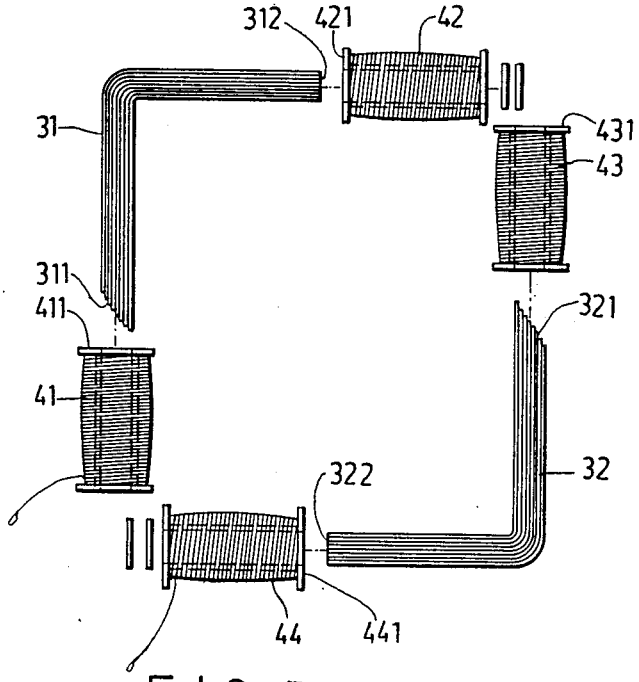
FIG. 5 is an exploded view of the preferred embodiment shown in FIG. 4.

Referring to FIG. 5, the iron core 3 of the preferred embodiment shown in FIG. 4 is composed of a pair of L-shaped silicon steel laminated cores 31 and 32, each of which is formed with an inclined end 311 (321) and a straight end 312 (322). The coil arrangement 4 includes a plurality of coils 41, 42, 43, 44 respectively wound on a plurality of I-shaped coil frames 411, 421, 431, 441, each having a through opening provided in the middle thereof. Both ends of the L-shaped laminated cores 31 and 32 are separately disposed in the coil frames 411, 421, 431, 441 and formed in a square configuration (as shown in FIG. 4) with the straight ends 312 and 322 respectively abutting against the inside surface of the inclined ends 311 and 321 so that a stabilizing device 5 having a square open section 51 defined in a middle portion and an annular circumference formed on an outer periphery is completed accordingly. The completed stabilizer 5 is electrically connected to a socket-adapter (not shown) and properly secured within a plastic housing unit 6, of which the socket seat for the miniature fluorescent lamp is located in the open section 51.

It shall be appreciated that the quantity of the coils 41, 42, 43 and 44 as well as the wiring method thereof may be varied according to the product requirement of the stabilizer 5 and the socket-adapter incorporated therewith. In addition, with the square-shaped configuration of the iron core 3, not only is a desired open section 51 formed in the middle, but a desirable degree heat dissipation for the coil arrangement 4 is also obtained.

Having thus described and illustrated the invention with a preferred embodiment, it will be understood by those skilled in the art that various changes and modifications may be made thereto without departing from the spirit and scope of the invention as defined in the appended claims.

What I claim is:

1. A stablizing device, for being incorporated into a socket-adapter for miniature fluorescent lamps comprising:

core means formed with plurality of L-shaped laminated cores for being assembled in a square configuration: and coil means formed with a plurality of core frames respectively wound with coils and sleevingly disposed around said L-shaped laminated cores so as to form a square-shaped structure with an open section defined in a middle portion thereof for accommodating a socket seat of the socket adapter in the open section:

wherein each of said L-shaped laminated cores includes a straight end and an inclined end so that when said laminated cores are combined together, a stabilizing device is formed having a square open section in a middle portion and an annular circumference on an outer periphery thereof:

wherein each of said coil frames is formed in a l-shape with a through opening provided in a central portion thereof to receive said straight end and said and inclined end of said L-shaped laminated cores so as to effect said core means;

wherein at least one of said coil means is mounted on each side of said square configuration of said core means.

* * * * *